US005485872A

United States Patent [19]

Kerger

[11] Patent Number: 5,485,872

[45] Date of Patent: Jan. 23, 1996

[54] DEVICE FOR CLOSING A NON-REFILLABLE BOTTLE, AND ADAPTORS FOR FILLING AND DRAINING THROUGH SUCH A DEVICE

[75] Inventor: Leon Kerger, Helmdange, Luxembourg

[73] Assignee: Luxembourg Patent Company S.A., Luxembourg

[21] Appl. No.: 273,636

[22] Filed: Jul. 12, 1994

[30] Foreign Application Priority Data

Jul. 12, 1993 [LU] Luxembourg ..... 88378

[51] Int. Cl.[6] ..... B65B 1/04; B65B 3/04

[52] U.S. Cl. ..... 141/329; 141/18; 141/19; 141/20; 141/383; 141/384; 141/325; 141/326; 141/285; 222/147

[58] Field of Search ..... 141/18, 19, 20, 141/21, 329, 330, 383, 384, 130, 325, 326, 3, 285; 222/3, 5, 147; 128/205.21

[56] References Cited

U.S. PATENT DOCUMENTS

| | | | |
|---|---|---|---|
| 2,120,248 | 6/1938 | Hinchman | 222/5 |
| 2,702,600 | 2/1955 | Allen | 141/19 |
| 3,093,979 | 6/1963 | Ehrens et al. | 222/5 |

*Primary Examiner*—Henry J. Recla
*Assistant Examiner*—Timothy L. Maust
*Attorney, Agent, or Firm*—Leydig, Voit & Mayer, Ltd.

[57] ABSTRACT

The closure of the bottle is achieved with the aid of a cylindrical ring (20), the base of which is closed by a membrane (22). This ring (20) is put in place together with a filling adaptor which is screwed onto the neck of the bottle and which allows the ring (20) to be tightened after filling. A drawing-off adaptor is also designed to be screwed onto the neck of the bottle and includes a bevelled drawing-off tube intended to pierce the membrane.

14 Claims, 2 Drawing Sheets

DEVICE FOR CLOSING A NON-REFILLABLE BOTTLE, AND ADAPTORS FOR FILLING AND DRAINING THROUGH SUCH A DEVICE

The present invention relates to a device for closing a non-refillable bottle. It also relates to adaptors for filling and draining a bottle through such a device.

The invention is aimed above all at bottles used for supplying refrigeration or air-conditioning plants with refrigerant. These are non-refillable bottles, that is to say bottles which are used just once and are abandoned where they are when they are empty. These bottles must include a device which allows them to be filled initially, and allows them to be drained. Given that the bottles are used just once, this device must be both effective and good value for money.

Hitherto, these bottles were generally equipped with a non-return valve allowing initial filling of the bottle through the valve. At the user station, a connector is screwed onto the valve and holds the closure member of the latter in an open position in order to allow the refrigerant to flow out.

Given that the empty bottles may be abandoned where they are by the user or the individual in charge of stocking the refrigeration plant with refrigerant, it sometimes happens that these empty bottles are taken away by other individuals, in general handymen who intend to use them for a use for which they were not designed, tampering with the valve in order to allow them to be filled up again. This of course constitutes a potential risk of accident, especially if the bottles may end up in the hands of children.

Given that the refrigerant contained in these bottles is generally a liquefied gas, it is also necessary, in order to avoid the risk of explosion in the event of overheating, for the bottles to be equipped with a safety valve. Hitherto, these were generally made up of a simple membrane which could burst under the effect of overfilling or excess pressure in the bottle.

The object of the present invention is to provide a device for closing a non-refillable bottle, which is simple, good value for money, and which exhibits hardly any risk of an accident in the event of inappropriate usage. Another object of the invention is to provide filling and draining adaptors which are specially designed for this closure device.

In order to achieve this objective, the closure device proposed by the present invention is characterized by a tubular coupling designed to be rendered integral with the wall of the bottle and exhibiting an internal annular shoulder which defines an opening for filling and draining the bottle, via a cylindrical ring closed by a membrane and the external diameter of which is larger than the diameter of the said opening, in that at least a part of the external surface of the ring has an external diameter corresponding to the internal diameter of the coupling, in that at least the middle part of the internal surface of the coupling and the said part of the external surface of the ring are equipped with corresponding screw threads and in that the external screw thread of the ring and/or the internal screw thread of the coupling have one or more longitudinal grooves passing through them.

It is therefore the membrane which seals the bottle and there is no longer any valve, which eliminates any risk of incorrect usage by tampering with the valve. In order to close the bottle after it has been filled, it is sufficient to screw and to tighten the ring together with its membrane into the coupling. In order to open the bottle it is sufficient to pierce the membrane through the ring. Furthermore, it is no longer necessary to provide a special safety device, given that the membrane can be designed in the form of a membrane which can burst in order to give to an exceptional excess pressure in the bottle.

In order to be able to screw the ring into the coupling, the ring exhibits on the opposite side from the membrane a shaped internal edge intended to receive an appropriate tool. The form of the shaped edge is such that the ring cannot be screwed with a screwdriver or conventional polygonal key so that only the specialist who has an appropriate and suitable tool can open or close the bottle. This further reduces the risks of an inappropriate usage of the bottle.

The coupling may exhibit an external screw thread in order to receive either a closure cap or an adaptor for filling or draining the bottle. The screw thread may, however, be replaced by another closure system, for example a bayonet-type closure system.

The grooves are preferably provided on the ring and penetrate into the wall of the latter beyond the depth of the screw thread. In effect, it is easier to make them in the ring than in the internal wall of the cap. In addition, in the ring, they may be deeper, which increases their overall cross section as well as the flow rate during filling.

The coupling may be surrounded by a protective shield secured to the wall of the bottle. This shield may, however, be removable so as to be able to take it off and thus facilitate the connection of an adaptor for filling or draining the empty bottle onto the coupling.

The invention also provides an adaptor for filling a bottle through a closure device of the sort described above, in which is engaged the ring with the membrane, without being tightened therein, comprising a substantially cylindrical body with an internal chamber open downwards and in communication with a coupling intended to be connected to a source of gas for filling, the base of the body being provided with a tapped thread in order to be screwed onto the external screw thread of the coupling of the closure device, a tool mounted so that it can rotate and slide in the said chamber with a shaped head the shape of which complements that of the ring of the device, and which tool is connected through the body to an external operating knob.

The body of the adaptor may include a housing for a seal intended to interact with the upper and internal edge of the coupling.

According to another aspect of the invention, an adaptor is provided for drawing off fluid from a bottle through a closure device of the sort described above and comprising a tap with a tapped thread designed to be screwed onto the external screw thread of the coupling of the closure device and an inlet duct, the cross section of which is smaller than the smallest internal cross sections of the coupling and of the ring and which includes a pointed lower edge designed to pierce the membrane when the adaptor is screwed onto the coupling.

The adaptor also includes a seal interacting with the internal wall of the coupling when the adaptor is screwed onto the coupling. The location of this seal is such that when the adaptor is screwed onto the coupling, sealing is achieved before the inlet duct pierces the membrane.

Other specific features and characteristics of the invention will emerge from the detailed description of one embodiment given below, by way of non-limiting example, with reference to the appended drawings in which:

FIG. 1 diagrammatically represents a section through the top of a bottle with a closure device according to the present invention;

Figure 1:
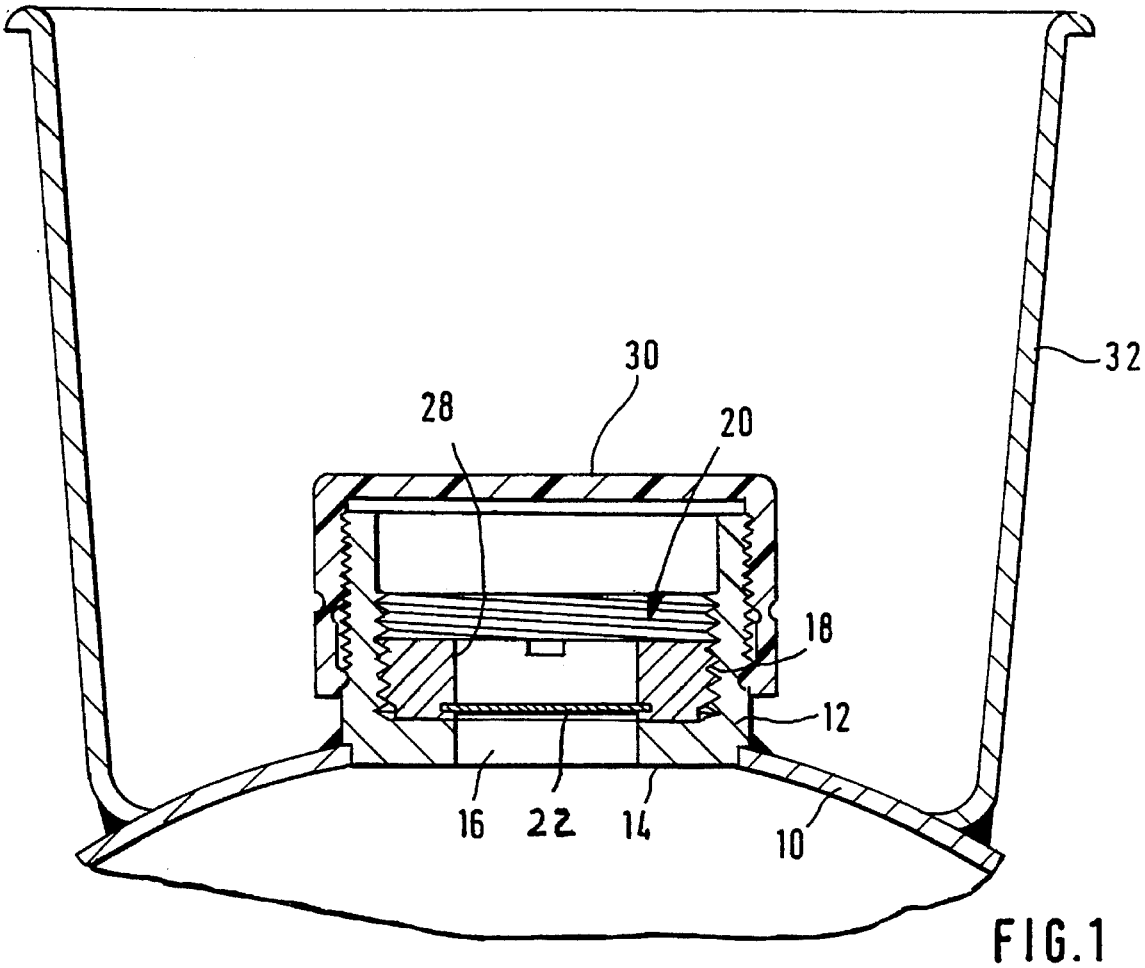

FIG. 1 shows the upper part of the wall 10 of a bottle equipped with a closure device in accordance with the present invention. This device includes a tubular coupling 12 rendered integral, for example by welding, with the wall 10. The base of this coupling includes an internal annular shoulder 14 around a circular opening 16 for filling and for drawing off the contents from the bottle. The internal wall of this coupling 12 may be smooth in the upper part and have a tapped thread 18 in the middle and lower region.

Figure 2:
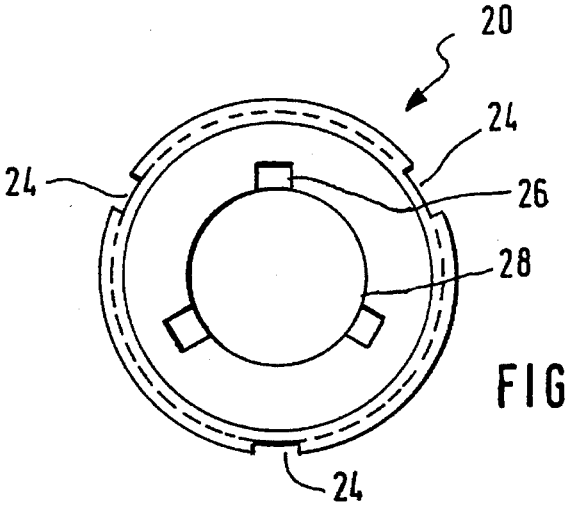
FIG. 2 represents a plan view of the ring.

A tubular ring 20, shown in plan view in FIG. 2 and provided with an external screw thread corresponding to the tapped thread 18, is designed to be fixed into the coupling 12. The base of the ring 20 may be narrowed with respect to the threaded part but its external diameter must be greater than that of the opening 16, so that the shoulder 14 forms a limit stop for the ring 20 when the latter is screwed into the coupling 12.

The ring 20 is closed, for example at its base, by a thin membrane 22, for example made of metal, which may be bonded or welded to the ring 20 and which ensures sealed closure of the opening 16 when the ring 20 is tightened into the coupling 12. In order to strengthen the degree of sealing between the ring 20 and the coupling 12, the bearing surface on the shoulder 14 around the opening 16 may be covered with a soft material.

The membrane 22 has a thickness designed so that it can contain a normal pressure in the empty bottle, but also so as to burst under the effect of an abnormal excess pressure in the bottle in the event of overheating.

The threaded part of the ring 20 has grooves 24 passing longitudinally through it (see FIG. 2). These grooves form a communication with the inside of the bottle when the ring 20 is not fully tightened into the coupling 12 and allow the bottle to be filled as will be described later.

The upper base of the ring 20, on the opposite side from the membrane, has a shaped form 26, around a central opening 28. This shaped opening 28 is intended to accommodate a tool of complementary shape in order to screw and tighten the ring 20 into the coupling 12. The shape of the opening 28 is preferably an unconventional form in order to prevent it from being possible for the ring 20 to be operated with a conventional tool such as a screwdriver or a polygonal key and thus to reserve the use of the bottle to authorized individuals who have the use of an appropriate tool.

The external surface of the coupling 12 may also be provided with a screw thread so as to receive a closure cap 30.

The coupling 12 may be surrounded by a protective shield 32 in order to prevent the coupling 12 from being damaged or from deteriorating during transportation of the bottles.

Figure 3:
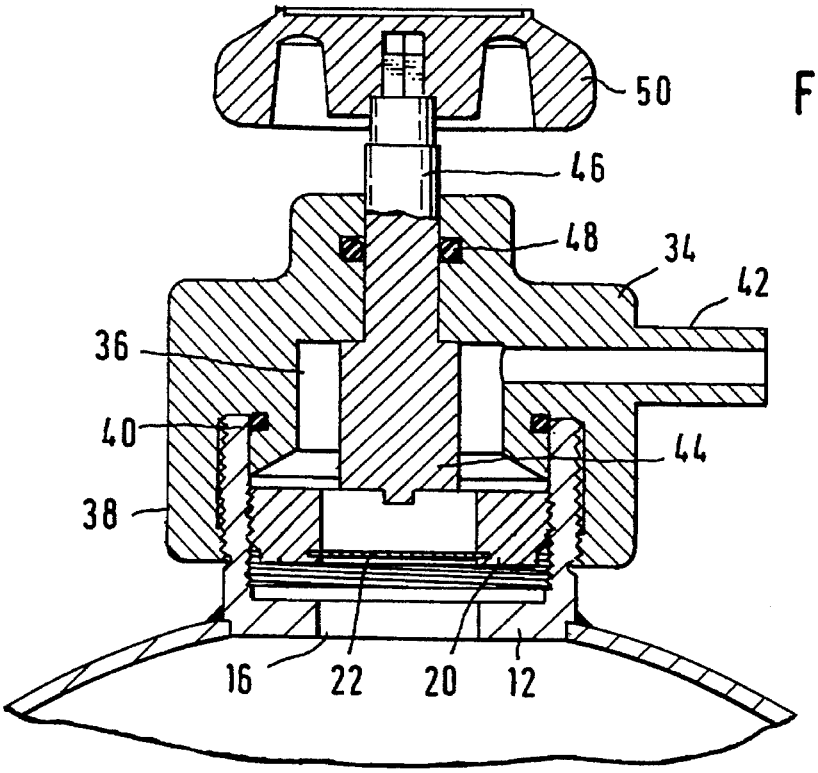
FIG. 3 represents a longitudinal section through a filling adaptor connected to the closure device and FIG. 4 represents, partially in longitudinal section, a draining adaptor connected to the device for closing a bottle.

FIG. 3 shows an adaptor specially designed to fill a bottle, at the factory, through the closure device of FIG. 1. This adaptor includes a body 34, for example made of metal, of generally cylindrical form, with an internal chamber 36 open downwards via an opening of a diameter equal to the external diameter of the coupling 12. The skirt 38 around this opening is provided with an internal screw thread allowing the adaptor to be screwed onto the coupling 12. In order to facilitate this connection onto the coupling 12, the skirt 38 may also be designed in the form of a cap nut. A seal 40 is housed in the wall of the body 34 so as to provide sealing with the internal surface of the coupling 12 when the adaptor is screwed onto the coupling.

The chamber 36 is in communication with an inlet coupling 42 which may be connected to a source of gas for filling the bottle.

Inside the chamber 36 there is a tool 44, the head of which has a shape of complementary form to that of the shape 26 of the ring 20. This tool 44 is secured to a rod 46 which can rotate and slide in the body 34 through a seal 48. The tool 44 may be actuated with the aid of an external knob, for example an operating handwheel 50 secured to the rod 46.

Figure 4:
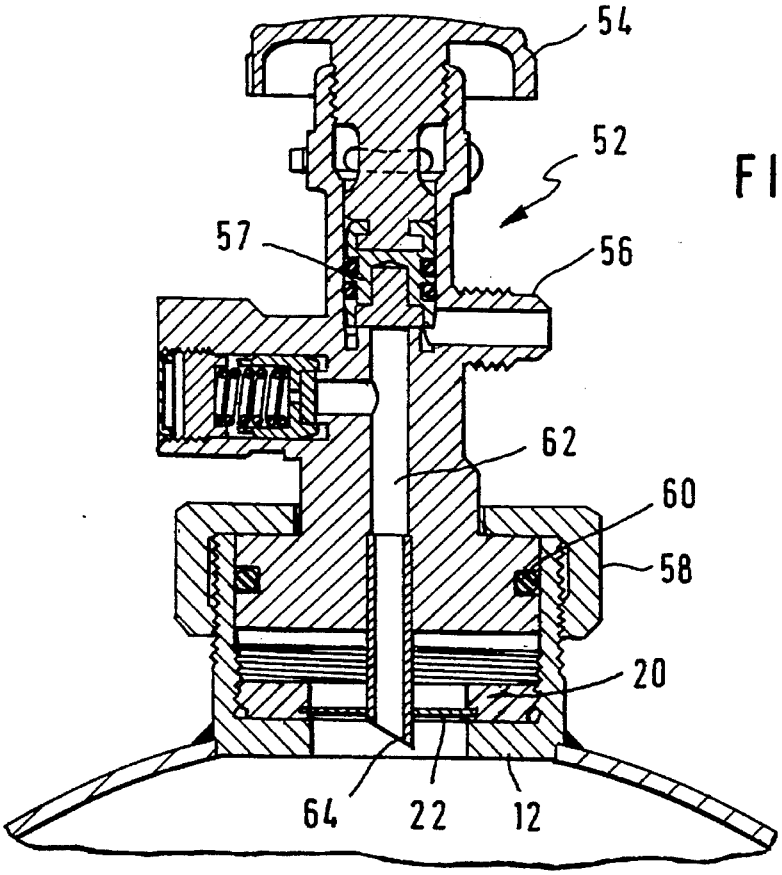

Before the bottle is filled, the ring 20 is inserted, with the membrane 22, into the coupling and engaged with the tapped thread of the coupling, without being tightened therein, in the position of FIG. 4. The adaptor is then tightened onto the coupling 12 and placed in communication with the source of gas for filling the bottle. The gas thus flows out through the chamber 36 and the open grooves 24 in the ring 20. Owing to the relatively large surface area of the opening 16, filling takes place more quickly than in conventional valve-type closure systems.

At the end of the filling process, the tool 44 is engaged with the ring 20, if this was not already done beforehand when the adaptor was connected. The ring 20 is then fully tightened with the aid of the handwheel 50 and after tightening, the adaptor may be taken off, the bottle thus being closed in a sealed manner by the membrane 22.

FIG. 4 shows an adaptor specially designed for draining a bottle through the closure device of FIG. 1 and for transferring its contents into the cooling circuit of a refrigeration plant. This adaptor is still taken away by the person in charge of stocking the plant with refrigerant.

The adaptor of FIG. 4 is in fact a sort of tap 52 with an operating handwheel 54 and a connector 56 which be connected up to the plant to be stocked. Inside the tap 52 there is a conventional closure member 57 which can be operated with the handwheel 54.

The base of the tap has a cap nut 58 which can rotate with respect to the body of the tap and is provided with an internal tapped thread corresponding to the external screw thread of the coupling 12. This cap nut 58 thus allows the tap 52 to be screwed onto the coupling 12. The base of the tap has a cylindrical form complementary to that of the coupling 12 with a seal 60 intended to interact with the internal surface of the coupling 12.

The internal inlet duct 62 is extended downwards through the body of the tap by a tube 64 with a very pointed lower edge, for example pointed owing to the fact that the tube 62 is bevelled. The diameter of this tube 64 is less than the central opening 28 of the ring 20.

When the tap 52 is screwed onto the coupling 12, preferably after having been connected up to the plant to be stocked, the pointed end of the tube 64 passes through the ring 20 and pierces the membrane 22. By opening the tap using the handwheel 54, the contents of the bottle can thus flow out freely through the pierced membrane into the plant.

It should be noted that in order to prevent leaks to the outside, the position of the seal 60 must be such that when the valve is connected to the coupling 12, sealing with the latter is achieved before the tube 64 digs into the membrane 22.

I claim:

1. Device for closing a non-refillable bottle, characterized by a tubular coupling (12) designed to be rendered integral with the wall of the bottle and exhibiting, at its base, an internal annular shoulder (14) which defines an opening (16) for filling and draining the bottle, via a cylindrical ring (20) closed by a membrane (22), the external diameter of said ring (20) being larger than the diameter of the said opening (16), in that part of the external surface of said ring (20) has an external diameter corresponding to the internal diameter of the coupling (12), in that at least the middle part of the internal surface of the coupling (12) and the said part of the external surface of the ring (20) are equipped with sets of internal and external screw threads, respectively, and in that at least one longitudinal groove (24) passes through one of said sets of screw threads to allow fluid to flow into said bottle when said ring (20) is loosely screwed into said coupling (12).

2. Device according to claim 1, characterized in that the said membrane (22) is a membrane which automatically bursts under the effect of an abnormal excess pressure in the bottle.

3. Device according to claim 1, characterized in that the ring (20) exhibits on the opposite side from the membrane, a shaped internal edge intended to receive a tool for screwing the ring (20) into the coupling.

4. Device according to claim 3, characterized in that the shaping of the edge has an unconventional form.

5. Device according to claim 1, characterized in that the coupling (12) has an external screw thread.

6. Device according to claim 1, characterized in that the groove (24) is provided on the ring (20) and penetrates into the wall of the latter beyond the depth of the screw thread.

7. Device according to claim 1, characterized in that the coupling (12) is surrounded by a protective shield (32) secured to the wall of the bottle.

8. A device for filling a bottle through a closure device according to claim 1, in which is engaged the ring (20) with the membrane (22), without being tightened therein, comprising a body (34) with an internal chamber (36) open downwards and in communication with a coupling (42) intended to be connected to a source of gas for filling, the body having a base provided with a tapped thread in order to be screwed onto the external screw thread of the coupling (12) of the closure device, a tool (44) mounted so that it can rotate and slide in the said chamber (36) with a shaped head the shape of which complements that of the ring (22) of the closure device, and which tool is connected through the body (34) to an external operating knob (50).

9. A device according to claim 8, characterized in that the body (34) includes a housing for a seal (40) intended to interact with an upper and internal edge of the coupling (12).

10. A device for drawing off a fluid from a bottle through a closure device according to claim 1, comprising a tap (52) having a base, having a tapped thread designed to be screwed onto the external screw thread of the coupling (12) of the closure device, and having an inlet tube (64), the cross section of which is smaller than the smallest internal cross sections of the coupling (12) and of the ring (20), with a pointed lower edge designed to pierce the membrane (22) when the adaptor is screwed onto the coupling.

11. A device according to claim 10, characterized in that the internal edge of the inlet tube (64) is bevelled.

12. A device according to claim 10 characterized in that the tapped thread of the tap is provided in a cap nut (58) at the base of the tap (52).

13. A device according to claim 10, characterized in that the tap (52) includes a seal (60) interacting with an internal wall of the coupling (12) when the adaptor is screwed onto the coupling (12).

14. A device according to claim 13, characterized in that the location of the seal (60) is such that when the adaptor is screwed onto the coupling (12), sealing is achieved before the inlet tube (64) pierces the membrane (22).

* * * * *